US005816404A

United States Patent [19]

Seidler

[11] Patent Number: 5,816,404

[45] Date of Patent: Oct. 6, 1998

[54] BLISTER PACK WITH BUILT-IN OPENERS

[76] Inventor: David Seidler, 69-10 108th St., Forest Hills, N.Y. 11375

[21] Appl. No.: 802,229

[22] Filed: Feb. 19, 1997

Related U.S. Application Data

[60] Provisional application No. 60/011,958 Feb. 20, 1996.

[51] Int. Cl.[6] ..... B65D 73/00; B65D 83/04

[52] U.S. Cl. ..... 206/461; 206/469; 206/531; 206/532; 222/83; 222/81

[58] Field of Search ..... 206/461, 469, 206/532, 531, 222; 222/80, 81, 83

[56] References Cited

U.S. PATENT DOCUMENTS

| | | | |
|---|---|---|---|
| 2,386,416 | 10/1945 | Wilhelm | 206/531 |
| 3,912,115 | 10/1975 | Smith | 222/81 |
| 4,457,427 | 7/1984 | Cafiero | 206/531 |
| 4,778,054 | 10/1988 | Newell et al. | 206/531 |
| 5,348,158 | 9/1994 | Honan et al. | 206/531 |
| 5,356,010 | 10/1994 | Weinstein | 206/532 |
| 5,505,326 | 4/1996 | Junko | 222/80 |
| 5,673,793 | 10/1997 | Seidler | 206/532 |

*Primary Examiner*—Paul T. Sewell
*Assistant Examiner*—Anthony Stashick
*Attorney, Agent, or Firm*—Kramer, Levin, Naftalis & Frankel

[57] ABSTRACT

A blister pack includes a frame defining at least one recessed compartment having an open side defining an opening for containing a product therein. A blister material covers the opening to removably seal the product in the compartment. An opener is supported by the frame over the opening with the opener being moveable to break the blister material and to remove the film to expose the product in the compartment for removal.

17 Claims, 4 Drawing Sheets

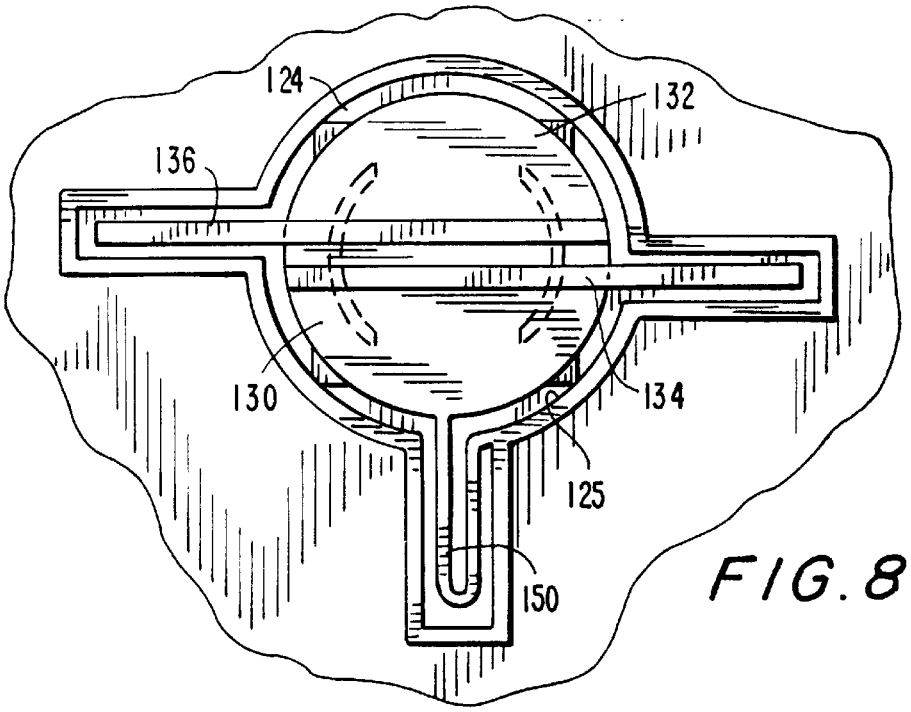
FIG. 8
FIG. 9
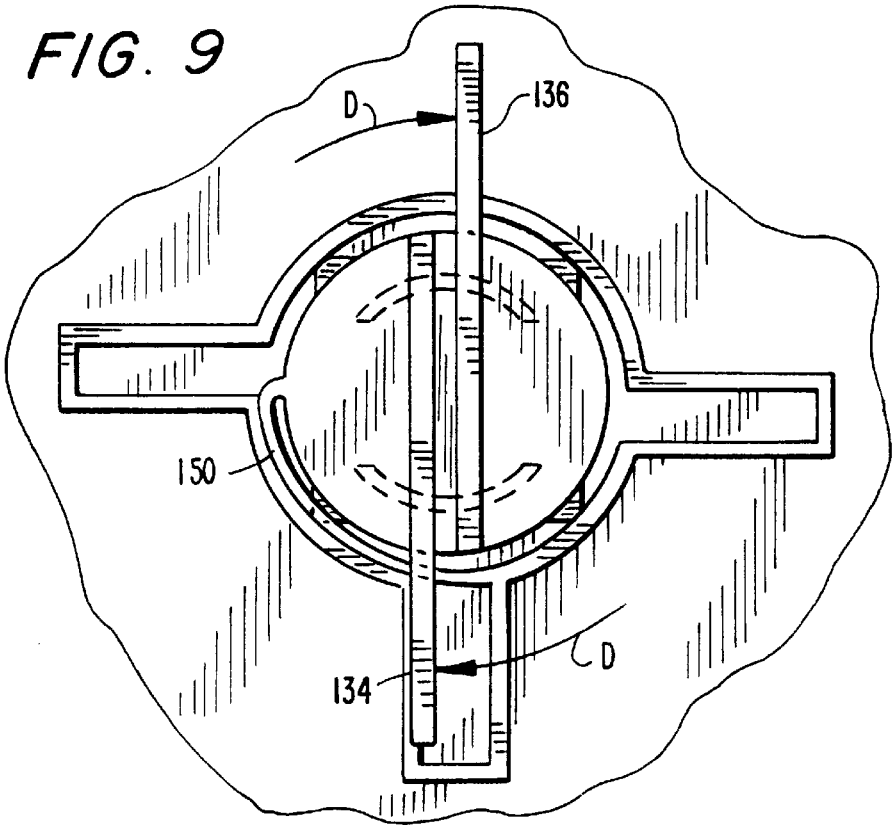

BLISTER PACK WITH BUILT-IN OPENERS

CROSS-REFERENCE TO RELATED PROVISIONAL APPLICATION

This application claims the benefit of U.S. Provisional application Ser. No. 60/011,958 filed on Feb. 20, 1996.

BACKGROUND OF THE INVENTION

The present invention is directed generally to a blister pack of the type in which product such as tablets or cream are contained in recessed compartments behind a breakable film seal and, in particular, to such a blister pack which includes a built-in opener device which is used to individually pierce and remove the film seal to open the compartment in which the product is contained.

Blister packs which support a plurality of tablets, capsules, pills, lotion, cream or other such product in individual recessed compartments formed in a thermoformed shell over which a film sheet such as foil or other pierceable material is provided, are well known. Many pills or other medicine, vitamins or the like are provided in such packages.

In order to remove the product from its compartment, the film or foil overlying the opening of the compartment must be pierced or otherwise broken to allow access to the product contained in the compartment therebelow. In some cases, pressing the tablet or other product through the deformable plastic against the film acts to press the product through the film allowing access thereto. In other situations where the foil is thick or otherwise where the product cannot be pressed through the foil, the foil must be pierced with a sharp object and then torn back to allow access to the product in the compartment. The compartments are generally formed in a thermoformed plastic material with a foil seal thereover.

Such blister packs are provided in order to ensure the integrity of the product contained therein and to provide a tamper resistant and tamper evident enclosure. In addition, such blister packs are provided as child resistant packages to prevent access to the tablets, capsules, pills, medication or other product contained in the compartment by children.

Another problem with such blister packs is experienced by the elderly, handicapped and lame who often find it difficult, if not in some cases impossible, to open such packages to obtain access to the product contained therein. This would be particularly true for those with arthritis or other motor control problems.

In some cases, the product such as pills, capsules, tablets or the like contained in each compartment, is friable and will be crumbled if pressed through the film or if contacted by a piercing device.

The present invention provides a product blister pack with built-in opener device which makes it easy and convenient to pierce and remove the film seal covering each compartment to expose the product contained in each compartment, while preventing contact with the product and resulting damage thereto, and at the same time continuing to provide tamper evident, tamper resistant and child resistant packaging.

SUMMARY OF THE INVENTION

Generally speaking, in accordance with the present invention, a blister pack having at least one compartment, but preferably a plurality of compartments, the openings of which are covered by a film seal, such as a foil seal, is provided. The blister pack includes a frame defining at least one recessed compartment having an open side defining an opening for containing a product therein. A blister material such as a film seal, foil seal or the like covers the opening to removably seal the product in the compartment. An opener is supported on the frame over the opening. The opener is displaceable to pierce the blister material and moveable to remove the blister material to expose the product for removal through the opening. Means are provided to prevent contact of the opener with the product.

In a preferred embodiment, the blister pack includes a plurality of compartments covered by a film seal. A panel includes a plurality of openings in the same general pattern as the layout of the compartments in the blister pack. An opener is supported by the sidewalls of each of the openings on the panel. The panel can be secured to the blister pack so that there is a correspondence between the openings in the panel and the compartments in the blister pack.

The openers are supported by the sidewalls of the openings using integrally formed plastic spurs, tabs or the like. The underside of each opener includes a piercing device which pierces the foil material when the opener is pressed downwardly toward the compartment. The opener can also be rotated to tear and remove the foil material covering the compartment to expose the product in the compartment for ready removal.

A ledge, rim or the like on the panel at each opening prevents the opener from contacting the product in the compartment. The opener may include a slot to receive a coin or the like to assist in manipulating the opener. An undercut or the like may be provided on the piercing device to retain the cut film.

A plastic strap may be used to retain the opener on the panel after use.

Accordingly, it is an object of the present invention to provide an improved blister pack.

Another object of the present invention is to provide a product blister pack with a built-in opener device.

A further object of the present invention is to provide a blister pack with built-in opener device which provides the product protection, evidence of tampering and resistance to tampering found on regular blister packs with an inexpensively manufactured and easily constructed device which allows ready opening of each compartment to expose the product for removal.

A still further object of the present invention is to provide a blister pack with built-in opener device which while easy to use for those with dexterity difficulties, is difficult to use by children thereby making it child resistant.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8 is a top plan view of an opener for a blister pack constructed in accordance with yet another embodiment of the present invention; and FIG. 9 is a view similar to FIG. 8 but showing the opener rotated after piercing and cutting the film.

DETAILED DESCRIPTION OF THE PREFERRED EMBODIMENTS

Figure 1:
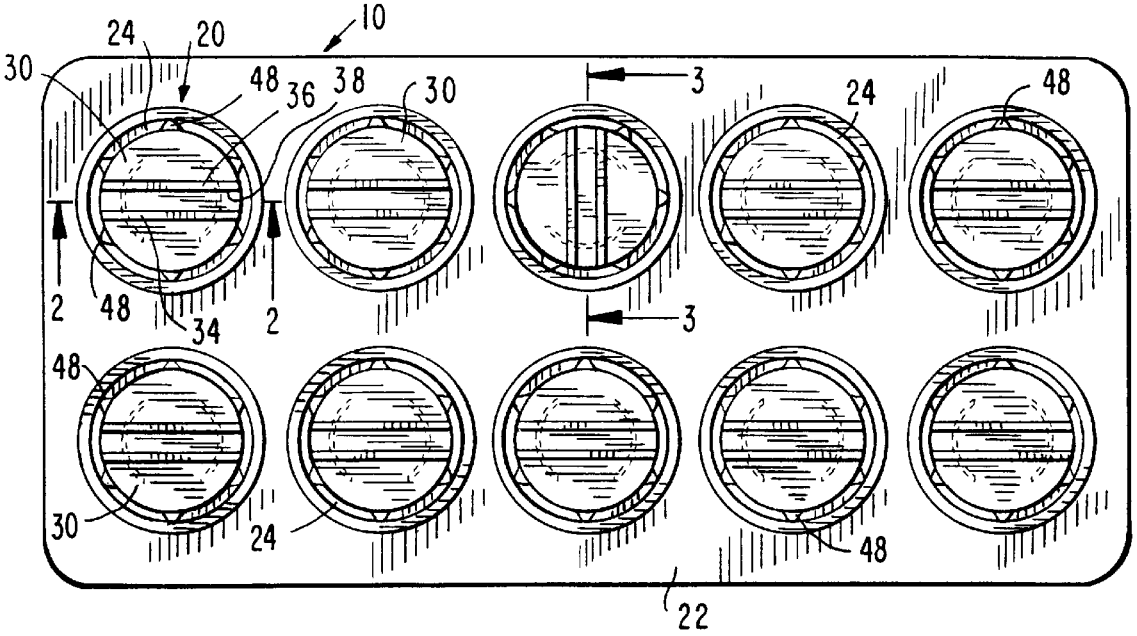
FIG. 1 is a top plan view of a blister pack with built-in opener system constructed in accordance with a first embodiment of the present invention, with one of the openers shown rotated to an open position.
Figure 2:
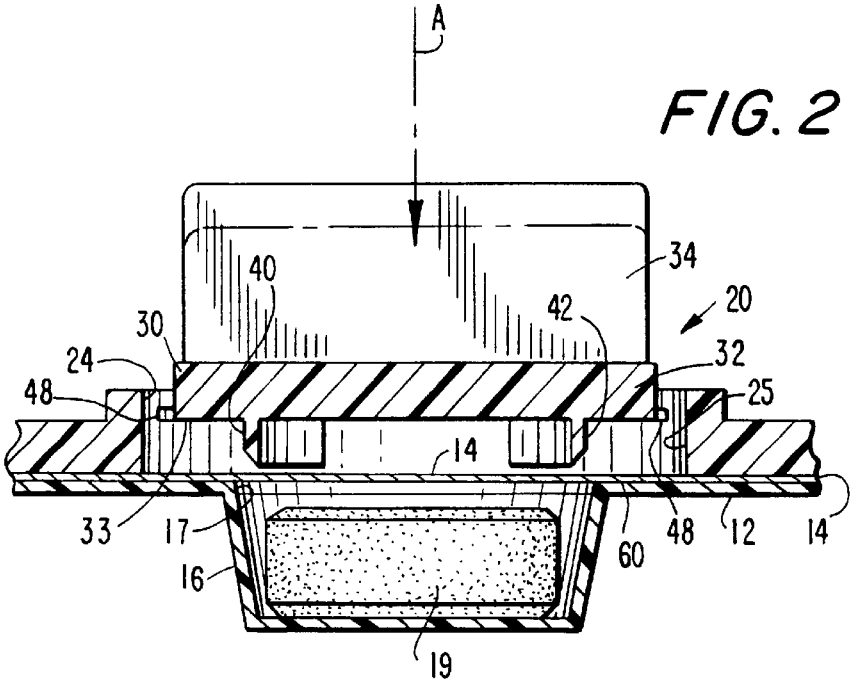
FIG. 2 is an enlarged sectional view taken along line 2—2 of FIG. 1.

Reference is first made to FIGS. 1 and 2 of the drawings which depict a blister pack, generally indicated at 10 shown incorporating a built-in opener system, generally indicated at 20, also constructed in accordance with a first embodiment of the present invention.

The blister pack 10 used in conjunction with the present invention is a multiple compartment thermoformed plastic product casing 12 having a film seal 14 thereover. Film seal 14 may be formed from a film sheet such as foil or other such pierceable material which can be secured to product casing 12 to seal each product such as a pill, tablet, capsule or the like in its respective compartment. Product casing 12 defines a plurality of recessed compartments 16 each having an open side defining an opening 17. Film seal 14 is secured by known conventional means to overlie each of openings 17 to seal product 19 in respective compartments 16. In the embodiment depicted, product 19 is a pill in the form of a tablet, but it is noted that other forms of solid material such as capsules, tablets or the like may fill compartments 16, or viscous material such as cream or the like may be found in compartment 16 to comprise product 19.

It is noted that blister pack 10 is formed in the conventional manner, first by thermoforming a plastic material with a plurality of depressions therein, then filling each of the depressions with the desired product, and then sealing a film such as a foil material seal on the upper surface of the thermoformed panel to cover each of the openings defined by the compartments, to secure the product therein.

In accordance with a preferred embodiment of the present invention, an opener system 20 is separately formed and then applied to the blister pack. It is noted however that the present invention should not be construed as limited to a separate construction for the opener system and it is envisioned that it may be formed as part of the blister pack itself. The construction of the opener system will now be described in detail.

Device 20 includes a panel 22 having a plurality of openings 24 formed therein. It is noted that openings 24, although shown round in the drawings, may be formed in different shapes, depending on the requirements of the opener device, as will hereinafter be described.

Each opening 24 is positioned on panel 22 so as to overlie a compartment 16 in blister pack 10 as depicted in FIG. 2, for example, and as will more fully be explained and hereinafter described. An opener 30, which may be, but is not required to be, circular as depicted in the drawings is provided in each opening 24.

Opener 30 includes a main body portion 32 and upstanding spaced walls 34 and 36 defining a slot 38 such as a coin slot therebetween. The lower surface 33 of body portion 32 includes piercer/cutter strips 40 and 42 in the shape of arcuate ribs. It is noted that the piercer and cutter strips may take different forms and shapes. Opener 30 is coupled to sidewall 25 of opening 24 by means of a plurality of plastic spurs, tabs or living hinge connectors 48 which as depicted are in the form of integrally formed plastic tabs.

It is noted that opening 24, in addition to being defined by sidewall 25, is also defined by a rim 60 which makes opening 24 larger than product compartment 16. The width or diameter of main body portion 32 of opener 30 is sized to ride on rim 60 such that main body portion 32 cannot fit into compartment 16, and only piercing elements 40 and 42 are allowed to enter compartment 16. In this fashion, the integrity of the product contained in compartment 16 will be maintained and the product will not be contacted at any time during opening of the compartment by tearing away of film seal 14.

Figure 3:
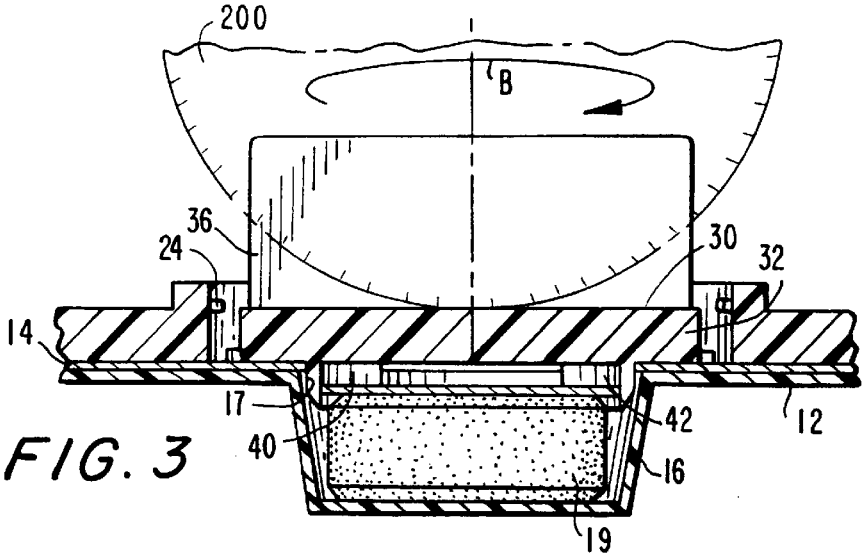
FIG. 3 is an enlarged sectional view taken along line 3—3 of FIG. 1.
Figure 4:
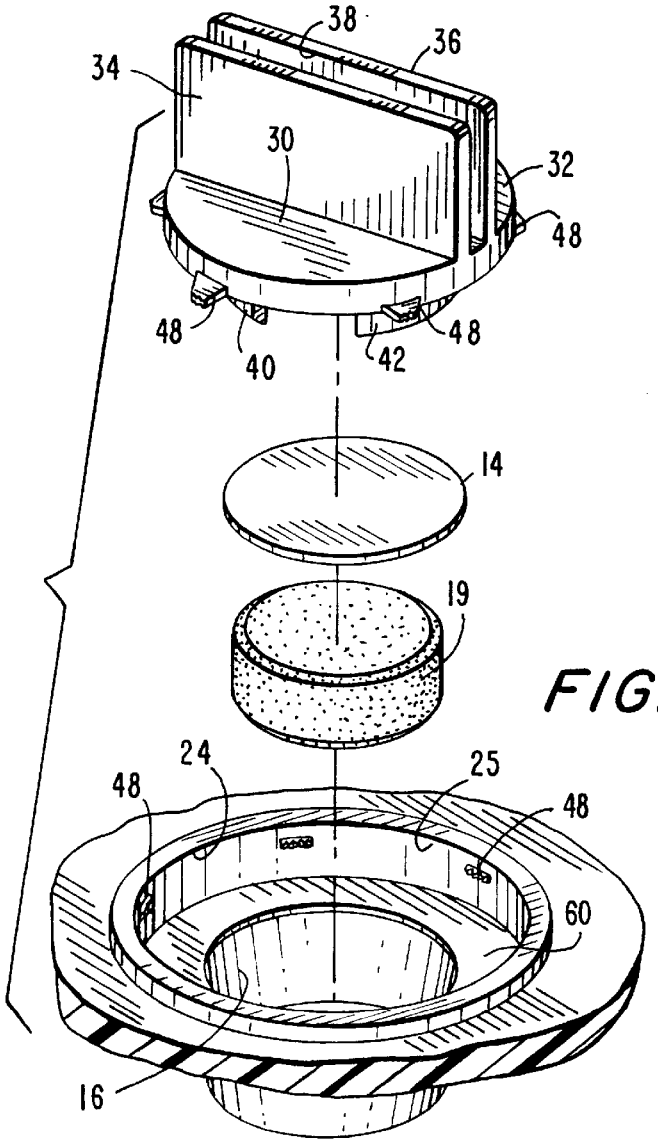
FIG. 4 is an enlarged exploded perspective view of the opener device of the present invention, also showing a pill removed from its compartment.

Referring now additionally to FIGS. 3 and 4, the operation of the present invention will be described.

After panel 22 is formed as depicted in FIG. 1, it is secured to the upper surface of blister pack 10 so that openings 24 correspondingly overlie each of the compartments formed in blister pack 10. Panel 22 may be coupled to blister pack 10 by any appropriate means such as by heat sealing, rivets, gluing or other adhesives, or ultrasonic means, or the like. Panel 22 is preferably injection molded and is inexpensive and easy to manufacture.

FIG. 2 depicts the situation before actuation or manipulation of opener 30 in the standby or pre-piercing position. Note that foil film 14 seals product 19 in compartment 16, and that piercers/cutters 40 and 42 are positioned above the foil film 14. When downward pressure is applied in the direction of arrow A on walls 34 and 36, tabs 48 will break or tear, and piercers/cutters 40 and 42 will pierce through film 14, as also shown in FIG. 3. Walls 34 and 36 can then be grasped and turned or rotated in the direction of arrow B (either clockwise or counterclockwise) whereby piercer/cutters 40 and 42 will cut through or rip film 14 covering compartment 16. It is noted that rim 60 prevents further downward movement of opener 30 thereby allowing only piercers/cutters 40 and 42 to enter compartment 16. In this fashion, the integrity of the product is maintained and even friable products will not be damaged.

It is also noted as shown in FIG. 3, for example, that a coin, such as coin 200 may be placed in slot 38 to assist in moving and turning opener 30.

After this manipulation of opener 30, opener 30 can be removed from opening 24, which allows removal of cut film 14 and then removal of product 19 from compartment 16, as shown, for example, in FIG. 4.

Figure 5:
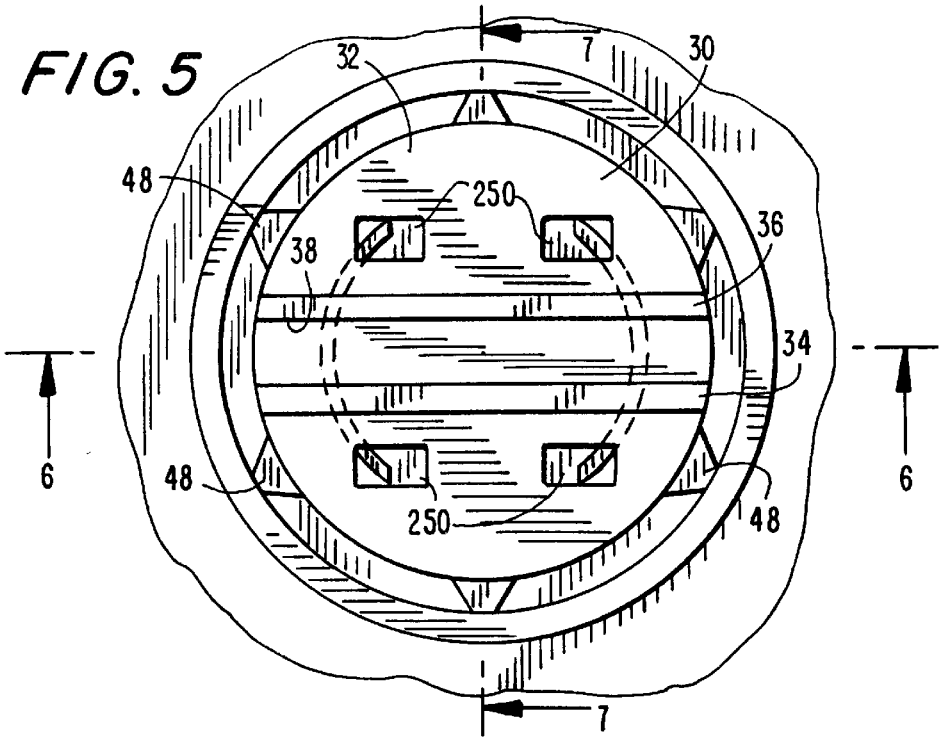
FIG. 5 is an enlarged top plan view of an opener for use in a blister pack constructed in accordance with an alternative embodiment of the present invention.
Figure 6:
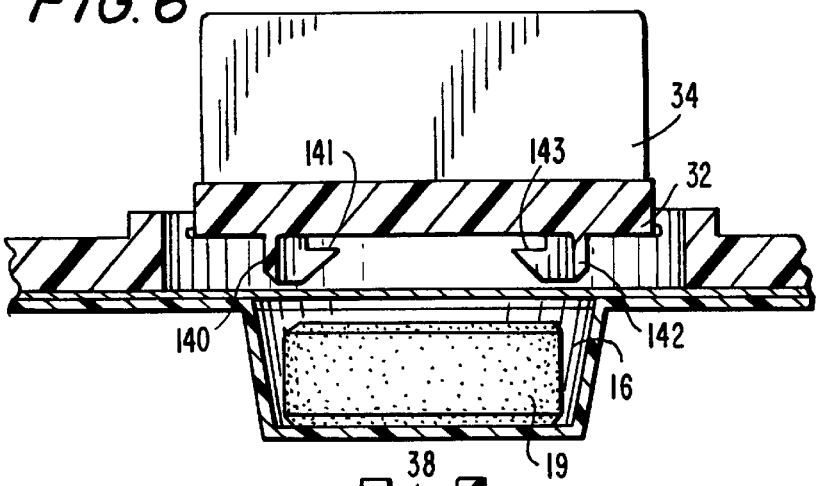
FIG. 6 is a sectional view taken along line 6—6 of FIG. 5.
Figure 7:
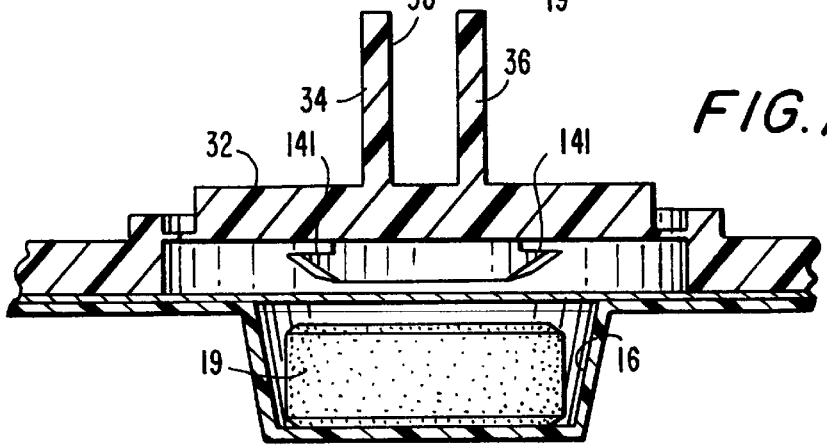
FIG. 7 is a sectional view taken along line 7—7 of FIG. 5.

Referring now to FIGS. 5 through 7, it is seen that opener 30 may include alternative piercers/cutters 140 and 142 which include undercuts 141 and 143 respectively at the opposite ends thereof. Undercuts 141 and 143 will capture and hold film seal 14 which is cut to expose compartment 16 thereby acting to prevent individual disposal of the cut film, or even accidental ingestion thereof. It is noted that seal-off holes 250 are provided in opener body 32 to facilitate molding of the undercuts.

Referring now to FIGS. 8 and 9, it is seen that walls 34 and 36 defining slot 38 (FIG. 4) which can either be grasped and turned by hand or a coin inserted in slot 38 to assist in turning, may be extended as shown by walls 134 and 136 as shown in FIGS. 8 and 9, to allow for easier finger purchase for rotating. If such extensions are utilized, it is noted that the extensions must be raised to allow for the downward movement of opener 30.

Another feature shown in FIGS. 8 and 9 is the provision of an integrally formed strap 150 which couples body portion 132 of opener 130 to sidewall 125 defining opening 124. In this fashion, strap 150 is long enough to allow opener 130 to be displaced and rotated in the direction of arrows D to allow piercing and cutting of the film. The advantage of strap 150 is that opener 130 will be retained on the panel in which it is formed thereby preventing independent disposal of opener 130, or even choking or accidental ingestion thereof.

In accordance with the foregoing, the present invention provides a blister pack with a built-in opener system wherein an opener device panel may be separately formed and then applied to a conventional blister pack to allow easy opening of the compartments in the blister pack without compromise or damage of the product contained in each compartment of the blister pack by even those who generally have difficulty opening such blister packs, while providing difficulty for children to open such packs. Thus, the present invention provides a blister pack with built-in opener device which while inexpensive and easy to manufacture, is tamper proof and tamper evident, child resistant, yet easy to use and manufacture.

It will thus be seen that the objects set forth above, among those made apparent from preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A blister pack comprising a frame defining at least one recessed compartment having an open side defining an opening for containing a product therein, a blister material covering said opening to removably seal said product in said compartment, an opener supported by said frame over said opening, said opener being displaceable to pierce said blister material and moveable to cut said blister material to expose said product through said opening, said opener being displaceable downwardly against said blister material to pierce said blister material, said opener being rotatable after piercing said blister material to remove said blister material to expose said product in said compartment, said opener including a first upstanding wall, said opener including at least one extension on the lower surface thereof to pierce and remove said blister material, said opener including at least a second upstanding wall spaced from said first upstanding wall to define a slot therebetween.

2. The blister pack as claimed in claim 1, wherein said opener includes said first upstanding wall on an upper surface thereof to allow said opener to be pressed against said blister material to pierce said blister material and rotated to remove said material.

3. The blister pack as claimed in claim 1, wherein said frame includes a panel overlying said blister material, said panel including at least one opening in alignment with said at least one compartment, said opener being supported by said panel in said panel opening.

4. The blister pack as claimed in claim 3, wherein said panel is formed from a thermoplastic material, said opener being formed with said panel and removeably attached to the sidewall defining said panel opening by integrally formed breakable tabs.

5. A blister pack comprising a frame defining at least one recessed compartment having an open side defining an opening for containing a product therein, a blister material covering said opening to removably seal said product in said compartment, an opener supported by said frame over said opening, said opener being displaceable to pierce said blister material and moveable to cut said blister material to expose said product through said opening, said frame including a panel overlying said blister material, said panel including at least one opening in alignment with said at least one compartment, said opener being supported by said panel in said panel opening, said panel being formed from a thermoplastic material, said opener being formed with said panel and removeably attached to the sidewall defining said panel opening by integrally formed breakable tabs, said panel opening defining a rim, said opener having a body portion larger than said rim, said body portion contacting said rim when displaced downwardly to prevent contact of said opener with said product.

6. The blister pack as claimed in claim 5 wherein said panel includes an integrally formed elongated strap coupling said opener to said panel.

7. The blister pack as claimed in claim 5, wherein said opener includes at least a second extension on the lower surface thereof, said first and second extensions including undercut portions.

8. An opener system for a blister pack, said blister pack including a plurality of compartments each of which includes product therein, and a film material overlying said compartments, the system comprising a panel formed from a thermoplastic material adapted to be secured to said blister pack, said panel including a plurality of openings therein positioned to correspond to the compartments in said blister pack, each opening being defined by a sidewall, an opener positioned in each said opening and removeably coupled to said sidewall, said opener including a piercing device on the lower surface thereof to pierce said film material, said opener being rotatable after piercing of said film material to remove said film material to expose said product in said compartment, said panel being coupleable to said blister pack so that said respective opener can be used to pierce and remove the film material and expose product in a corresponding compartment.

9. The opener system as claimed in claim 8, wherein said opener is coupled to said sidewall by an elongated strap.

10. The opener system as claimed in claim 9, wherein said elongated strap is integrally formed with said panel and opener.

11. The opener system as claimed in claim 10, wherein each said opener is removeably coupled in its respective opening by breakaway tabs.

12. The opener system as claimed in claim 11, wherein said opener includes a flange on the upper surface thereof.

13. The opener system as claimed in claim 11, wherein said opener includes at least one extension on the lower surface thereof, said extension defining a piercer/cutter.

14. The opener system as claimed in claim 13, wherein said opener further includes a second extension defining a piercer/cutter, said first and second including undercuts.

15. The opener system as claimed in claim 8, wherein said opener is circular and includes a coin slot on the upper surface thereof.

16. The opener system as claimed in claim 15, wherein said coin slot is defined by opposing spaced walls each having an extension to allow easy finger purchase.

17. The opener system as claimed in claim 9, wherein said strap permits movement of said opener towards said compartment to pierce said film material and permits rotary movement to remove said film to expose said product in said compartment.

* * * * *